US006383238B1

(12) United States Patent
Takahashi et al.

(10) Patent No.: US 6,383,238 B1
(45) Date of Patent: May 7, 2002

(54) RESIN BONDED ABRASIVE TOOL

(75) Inventors: Tsutomu Takahashi; Toshiyuki Takano; Masato Nakamura, all of Iwaki (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/636,461

(22) Filed: Aug. 11, 2000

(30) Foreign Application Priority Data

| | | |
|---|---|---|
| Aug. 17, 1999 | (JP) | 11-230909 |
| Aug. 31, 1999 | (JP) | 11-246748 |
| Feb. 16, 2000 | (JP) | 2000-038653 |

(51) Int. Cl.[7] ..... B24D 3/02; B24D 3/00; B24D 3/32; B24D 3/34

(52) U.S. Cl. ..... 51/298; 51/296; 51/307; 51/309

(58) Field of Search ..... 51/298, 296, 295, 51/307, 309

(56) References Cited

U.S. PATENT DOCUMENTS

| | | | | |
|---|---|---|---|---|
| 3,664,819 A | * | 5/1972 | Sioui et al. | 51/295 |
| 3,957,461 A | * | 5/1976 | Lindstrom et al. | 51/295 |
| 5,095,665 A | * | 3/1992 | Nagata et al. | |
| 5,096,661 A | * | 3/1992 | Lang | 419/2 |
| 5,429,648 A | * | 7/1995 | Wu | 51/296 |
| 5,607,264 A | * | 3/1997 | Konin et al. | 51/309 |
| 5,827,337 A | * | 10/1998 | Keil | 51/298 |
| 5,912,216 A | * | 6/1999 | Thimmappaiah et al. | 51/298 |

FOREIGN PATENT DOCUMENTS

| | | |
|---|---|---|
| JP | 74001516 B * | 1/1974 |
| JP | 63-144966 | 6/1988 |
| JP | 4-87774 | 3/1992 |
| JP | 4-87775 | 3/1992 |
| JP | 5-84666 | 4/1993 |
| JP | 7-156068 | 6/1995 |
| JP | 7-227765 | 8/1995 |
| JP | 8-113774 | 5/1996 |
| JP | 8-276366 | 10/1996 |
| WO | WO 96/29179 | 9/1996 |

OTHER PUBLICATIONS

Patent Abstracts of Japan, vol. 1999 No. 03, JP 10330732, Dec. 1998.*

Patent Abstract of Japan, vol. 017, No. 026, JP 04250981, Sep. 1992.*

Patent Abstract of Japan, vol. 013, No. 477, JP 01188272, Sep. 1989.*

Derwent Publications, AN 1993–374032, JP 05277956, Oct. 1993.*

* cited by examiner

*Primary Examiner*—Michael Marcheschi
(74) *Attorney, Agent, or Firm*—Oblon, Spivak, McClelland, Maier & Neustadt, P.C.

(57) ABSTRACT

The abrasive particle layer of resin bonded abrasive tool is constructed by resin binder phase consisting of heat hardening resin, for example, phenol resin etc. and super abrasive particle of diamond (or CBN etc.) distributed in this resin binder phase. The wear resistant filler consisting of SiC, for example, as hard filler and hollow glass and metal coated amorphous carbon is distributed in resin binder phase. The amorphous carbon is made to spherical shape and metal coating layer consisting of Cu, for example, as the metal having high thermal conductivity, is set on a surface of this amorphous carbon.

21 Claims, 5 Drawing Sheets

RESIN BONDED ABRASIVE TOOL

BACKGROUND OF THE INVENTION

1. Field of the Invention

This invention relates to a resin bonded abrasive tool particularly useful, for example, for mill grinding of hard and brittle.

The disclosure of Japanese Application No. H11-230909, H11-246748, and 2000-038653 is hereby incorporated by reference into the present application.

2. Description of the Background

Generally, resin bonded abrasive tools are produced by the following method. The raw powders of thermosetting resin, such as, for example, an epoxy resin and phenol resin, are mixed with the super abrasive grains of a diamond and CBN, etc. This mixture is molded independently, or with a base metal if needed. Then, it is pressed and sintered. The result is a resin bonded abrasive tool having a super abrasive grains layer.

When the grinding is performed to comparatively hard work materials, the resin bonded phase holding super abrasive grains is crushed or worn out. Super abrasive grains drop out rather than decrease in sharpness by the wear in a tip of the super abrasive grain, because, in resin bonded tool, the resin bonded phase holding the super abrasive grains is comparatively elastic and brittle. Therefore, although resin bonded tools are susceptible to intense wear, clogging on a surface of grinding and a decrease in sharpness of a super abrasive grain due to wear are not common. Thus, resin bonded tools are able to perform grinding efficiently as compared with metal bonded tool, etc. Moreover, the damage to work materials is small and the finished surface is good, due to the elastic effect of the super abrasive grains held by resin bonded phase. Therefore, it has the advantage of being used for the grinding where small surface roughness such as mill grinding of work materials of semi conductor wafer for example is required. By the way, in the conventional resin bonded tool, solid lubricant, such as hBN and graphite for example, is dispersed inside of the resin bonded phase as filler in order to control the frictional heat generated by grinding resistance.

For example, in resin bonded tool 1 shown in FIG. 9, diamond abrasive grain 4 dispersed inside of resin bonded phase 3 consisted of phenol resin as grain layer 2. Solid lubricant 5 such as $CaF_2$ (calcium fluoride), etc. is added and further distributed. In case of the grinding by using these resin bonded abrasive tool, the solid lubricant 5 inside of resin bonded phase 3 has a function as lubricant in omitting one by one with resin bonded phase 3 and abrasive grain 4 and aids smoothly performed grinding by a super abrasive grain 4. The solid lubricant 5 may also aid in controlling the friction heat of grain layer 2 and work material.

OBJECT OF THIS INVENTION

However, although cutting resistance can be reduced by the addition of solid lubricant which is distributed as filler in resin bonded abrasive tool of above mentioned composition, the problem remains that the life of abrasive tool is short by the reason that the binder phase of resin is brittle. Also, increasing the wear resistance of abrasive particle layer is difficult to achieve. This invention aims at offering resin bonded abrasive tool which can raise wear resistance and reduce the grinding resistance.

SUMMARY OF THE INVENTION

In order to attain the purpose which solves the above mentioned subject, the resin bonded abrasive tool of this invention is characterized by distributing amorphous carbon in the above mentioned resin binder phase in resin bonded abrasive tool which comes to distribute super abrasive particle in resin binder phase. The amorphous carbon (also referred to as "glassy carbon") has the characteristics that the bending strength is at about 16 kg/mm2, a value about 5 times to graphite ("also referred to as "crystal carbon"). Also, the compressive strength is at about 120 kg/mm2, a value about 20 times greater than for graphite. The modulus of elasticity is about 3 times greater than for graphite, and the shore hardness Hs is at about 110, a value about 3 times greater than for graphite. Here, the binder phase of resin bonded abrasive tool is made, for example, from phenol resin, the modulus of elasticity of the phenol resin is at about 7×102 kg/mm2, The rate of modulus of elasticity of abrasive particle layer of resin bonded abrasive tool can be raised by adding and distributing amorphous carbon in resin binder phase of resin bonded abrasive tool. This can raise the compressive rigidity of abrasive particle layer. Also, the abrasive particle layer can carry out compressive deformation by grinding resistance at the time of grinding, or it can prevent super abrasive particle from being buried into resin binder phase even where the super abrasive particle projects from the surface of abrasive particle layer and forms the cutting tooth of resin bonded abrasive tool which receives the grinding resistance. Further, the mechanical strength of abrasive particle layer holding super abrasive particle can be raised. Furthermore, the amorphous carbon distributed in resin binder phase acts as lubricant, can reduce the grinding resistance between work materials, and can control the generation of grinding heat. In addition, for example, it can control more effectively the deformation of resin bonded abrasive tool, or the wear of the tool because the hardness, compressive strength and bending strength of amorphous carbon is large compared with solid lubricant such as graphite. Furthermore, the resin bonded abrasive tool in this invention has the characteristics that the above mentioned amorphous carbon is the shape of spherical type. In above mentioned resin bonded abrasive tool, spherical amorphous carbon can raise the compressive strength of resin binder phase, and it also relieves the stress which acts to the abrasive particle layer at the time of grinding machining.

Moreover, as the spherical amorphous carbon exposed from the surface of abrasive particle layer contacts the grinding surface of work materials, the frictional resistance is small and the generation of frictional heat is suppressed small even if the friction with the work materials arises. Moreover, if the resin binder phase which holds spherical amorphous carbon on the surface of abrasive particle layer is worn out and approximately half grade of the whole volume of the spherical amorphous carbon comes to project from the surface of abrasive particle layer, this amorphous carbon will be omitted from the surface of abrasive particle layer, and a tip pocket will be formed in the position where the amorphous carbon was held. That is, compared with non uniform shape particles by which unevenness was formed, for example, on the outside surface, amorphous spherical carbon promotes a decrease in the holding force by resin binder phase and omission from resin binder phase. The discharge ability of scraps improves in that the grinding liquid is introduced at the time of grinding machining or grinding waste etc. enters into the formed tip pockets.

On the other hand, as the amorphous carbon is spherical, the compressive strength is high compared with non uniform type, the grinding load and the deformation by grinding can be controlled, and it can prevent effectively burying into the resin binder phase of super abrasive particle which exists in the outside surface. Furthermore, the mobility and formability of raw materials can be raised in case that the abrasive particle layer is formed. Furthermore, the resin bonded abrasive tool has the characteristics that the above mentioned amorphous carbon is non uniform shape.

In resin bonded abrasive tool mentioned above, particularly, in case that the minute amorphous carbon is dispersed in resin binder phase, the spherical amorphous carbon is in the tendency of dropping out from resin binder phase. The holding force can be raised by using the amorphous carbon of non uniform shape. Furthermore, the resin bonded abrasive tool in this invention has the characteristics that the amorphous carbon of the above mentioned non uniform shape results from grinding spherical amorphous carbon. Although the minute and spherical amorphous carbon has the problem that the manufacture is difficult and moreover tends to drop out from resin binder phase, for example, the non uniform shape amorphous carbon which has a particle size distribution which is shown in FIG. 7 can be obtained easily by crushing the spherical amorphous carbon against that the mean particle diameter about 20~30 μm shown in Table 1 and FIG. 10. The holding force by resin binder phase can be raised and the wear resistance of resin bonded abrasive tool can be raised.

And the spherical amorphous carbon is the most precise and the precise and minute shape amorphous carbon can be obtained by crushing the spherical amorphous carbon. Furthermore, the resin bonded abrasive tool in this invention has the characteristics that the particle diameter of above mentioned non uniform shape amorphous carbon is 20 μm or less. If the particle diameter of the amorphous carbon of non uniform shape distributed in resin binder phase exceeds 20 μm in above mentioned resin bonded abrasive tool, the contact length of work material and resin may increase and the grinding resistance may increase. However, by setting particle diameter to 20 μm or less, the amorphous carbon is arranged in a narrow pitch and the contact of the work material and resin is controlled. As a result, the grinding resistance is reduced and the generation of grinding heat is controlled. Also the wear resistance of resin bonded abrasive tool can be raised. Furthermore, the resin bonded abrasive tool of this invention has a characteristic that the metal of Cu or Ag or Ni or Co or alloy including these metals is coated on a surface of above mentioned amorphous carbon. In above mentioned resin bonded abrasive tool, the amorphous carbon coated by metal which is a high thermal conductivity is distributed in abrasive particle layer. As a result, the thermal conductivity of abrasive particle layer can be raised, the heat which occurs at the time of grinding machining can be made to be able to emit quickly from abrasive particle layer, and the deterioration of resin binder phase can be prevented. Furthermore, the resin bonded abrasive tool in this invention has a characteristic that the volume ratio of above mentioned amorphous carbon to the above mentioned resin binder phase except super abrasive particle is 5~60 vol %. In above mentioned resin bonded abrasive tool, if the amorphous carbon becomes less than 5 vol %, the effect which controls the generation of the wear heat based on the decreasing of grinding resistance and improve the wear resistance of abrasive particle layer is weak where the volume exceeds 60% conversely, since the the ratio of resin binder phase which occupies in abrasive particle layer will decrease, the strength of the abrasive particle layer decreases. The wear resistance of abrasive particle layer also decreases, and economical efficiency falls. Furthermore, the resin bonded abrasive tool in this invention has a characteristic that the hardness of amorphous carbon is Hs=100~120 inshore hardness scale. In above mentioned resin bonded abrasive tool, the amorphous carbon is produced by baking phenol formaldehyde resin at 500° C.~3000° C. If it is baked below 600° C., the shore hardness becomes less than 100, and since the hardness of amorphous carbon is small, the deformation of the resin bonded abrasive tool and inclination wear can not be controlled. Also, since the lubricity is low, the generation of grinding heat by the decreasing grinding resistance between work materials cannot be controlled. On the other hand, hardness is as high as which was baked at high temperature, and it serves as amorphous carbon excellent in lubricity. Furthermore, the resin bonded abrasive tool in this invention has a characteristic that at least one wear resistant filler can be present in the above mentioned resin binder phase. In this resin bonded abrasive tool, hard wear resistant filler is also distributed. As a result, the strength of the abrasive particle layer is raised, wear can be reduced and amorphous carbon is distributed. As a result, the decreasing of grinding resistance is decreased without decreasing the grinding ratio. Furthermore, the resin bonded abrasive tool in this invention has a characteristic that the above mentioned wear resistant filler includes at least one of SiC, SiO2, Ag, Cu, Ni. In above mentioned resin bonded abrasive tool, since at least one of SiC, SiO2, Ag, Cu, Ni as the filler is included, the wear of abrasive particle layer is controlled much more, and prolongation of abrasive tool life can be controlled. Furthermore, the resin bonded abrasive tool in this invention has a characteristic that at least one lubricative filler is distributed in resin binder phase. In above mentioned resin bonded abrasive tool, since the lubricative filler is distributed, the grinding resistance is reduced. The grinding ratio can be raised without increasing grinding resistance by distributing amorphous carbon to resin bonded abrasive tool with the sufficient sharpness planned so that the grinding of the work material by super abrasive particle could be smoothly performed at the time of grinding. Furthermore, the resin bonded abrasive tool in this invention has a characteristics that the above mentioned lubricative filler includes at least one of graphite, hBN, or fluoro-resin. In above mentioned resin bonded abrasive tool, since at least one of graphite, andd hBN, fluoro-resin can be lubricative filler, the grinding resistance is reduced much more. Thus, the resin bonded abrasive tool which is excellent in sharpness and, which can perform the grinding of work material smoothly can be obtained. Furthermore, the resin bonded abrasive tool in this invention has a characteristic that the pores are included 5~40 vol % in resin binder phase. In this resin bonded abrasive tool, the pores have effects such as inducing the grinding liquid on a surface of abrasive particle layer, improving the discharge ability of tip, and preventing condensation with work material. As a result, by the synergistic effect with the amorphous carbon, grinding resistance is reduced much more and there is a remarkable effect in an improvement of the grounded surface roughness of work material. Here, if the pore volume is less than 5 vol %, the effect mentioned above is weak. In case that the pore volume exceeds 40 vol %, the strength of the abrasive particle layer will decrease. Furthermore, the resin bonded abrasive tool in this invention has a characteristic that the hollow glass is distributed in resin binder phase. In this composition, the part of the hollow glass exposed from the surface of the abrasive particle layer is destroyed by the contact with work material at a time of grinding. As a result, the tip pocket is formed and the discharge ability of the tip can be improved, and in addition, the strength of the abrasive layer that was decreased by the addition of hollow glass can be raised by the addition of amorphous carbon simultaneously. It can be possible to obtain the resin bonded abrasive tool excellent to the sharpness. In addition, where the lubricative filler is distributed in resin binder phase adding to hollow glass, (although there are the case where the strength decreases even to the state where the strength of abrasive particle layer becomes weak much more and practical use is not possible, for example, by exchanging a part of lubricative filler such as graphite to amorphous carbon), the strength of abrasive particle layer, in particular, the compressive strength can be raised, and the resin bonded abrasive tool excellent to the sharpness can be obtained.

BRIEF DESCRIPTION OF THE DRAWINGS

Table 1 is a particle size distribution of spherical amorphous carbon.

Table 2 is a particle size distribution of non-uniform shape amorphous carbon.

EXPLANATION OF MARK

Figure 1:
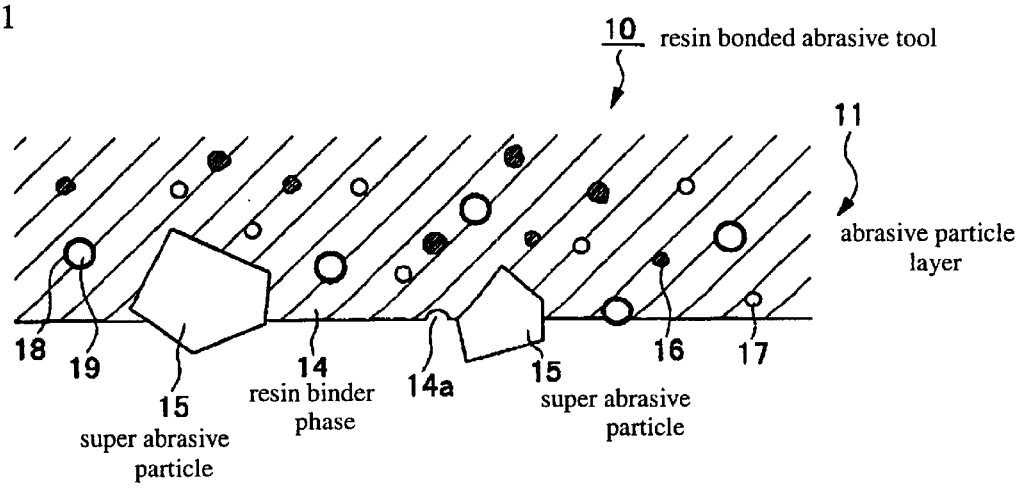
FIG. 1 is an enlarged sectional view of the principal part shown as one example of resin bonded abrasive tool concerning this invention.

10, 20, 30: Resin bonded tool
11, 21, 31: Abrasive particle layer
14: Resin binder phase
15: Super abrasive particle
16: wear resistant filler
17: Hollow glass
18: Metal coated layer
19: Amorphous carbon
22: Lubricative filler
36: Filler

BRIEF DESCRIPTION OF THE PREFERRED EMBODIMENTS

Figure 2:
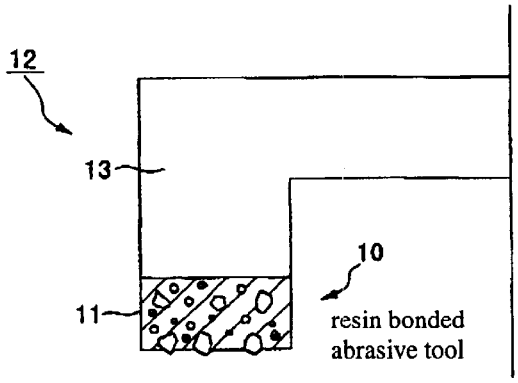
FIG. 2 is a part of the sectional view of cup type abrasive tool in which an abrasive particle layer is equipped to the base plate shown in FIG. 1.
Figure 3:
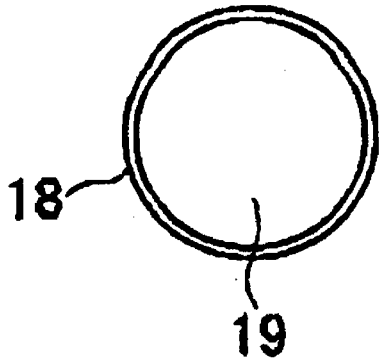
FIG. 3 is a sectional view of amorphous carbon which has the metal coating layer shown in FIG. 1.

Referring to the drawings, examples of resin bonded abrasive tool in this invention are explained. FIG. 1 is an enlarged sectional view of a principal part of one example of resin bonded abrasive tool 10 concerning this invention. FIG. 2 is a sectional view of a part of cup type abrasive tool 12 in which the abrasive particle layer 11 is equipped with the base plate shown in FIG. 1, and FIG. 3 is a sectional view of an amorphous carbon 19 which has the metal coating layer 18 shown in FIG. 1.

Resin bonded abrasive tool 10 by the example in this invention is, for example, the abrasive tool using for miller grinding of hard and brittle material. The abrasive particle layer may be fixed to the tip part of almost ring like of the base plate 13 in cup type abrasive tool 12 shown in FIG. 2, for example. The abrasive tool may be constituted by only abrasive particle layer 11 without forming base plate 13. And as shown in FIG. 1, the abrasive particle layer 11 is equipped with resin binder phase 14 which heat-hardening resin such as phenol resin etc., for example, and super abrasive particle 15 of diamond (or cBN etc.) which is distributed in this resin binder phase 14. Furthermore, wear resistant filler 16 and hollow glass 17 and amorphous carbon 19 that has the metal coating layer 18 are distributed in resin binder phase 14 respectively. Although the wear resistant filler 16 is not particularly limited, it is desirable to include at least one hard filler of SiC, SiO2, Ag, Cu, or Ni, preferably SiC, for example. As shown in FIG. 3, a metal coating layer 18 may be on the surface of amorphous carbon 19. This metal coating layer 18 the metal Cu, Ag, Ni, or Co, or alloys including these metals, preferably Cu. It is supposed that the amorphous carbon 19 is spherical, for example, and although the particle diameter is not particularly limited, the particle diameter is set preferably in the range of 1/10~2 of the particle diameter of super abrasive particle 15.

Here, if the particle diameter of amorphous carbon 19 is less than 1/10 of the particle diameter of super abrasive particle 15, the effect that decrease the grinding resistance, control the generation of grinding heat and [also the effect that] increase the wear resistance are weak. Conversely, if it is more than 2 times of the particle diameter of super abrasive particle 15, the distributed pitch of amorphous carbon 19 will be extended, and the contact length between work material and resin binder phase 14 will be increased, thereby increasing grinding resistance. The total amount of amorphous carbon 19 is made into 5~60 vol % by the volume ratio of resin binder phase 14 except super abrasive particle 15 of abrasive particle layer 11. Here, if the quantity of amorphous carbon 19 is less than 5 vol %, the effect which include amorphous carbon 19, for example, the decreasing of grinding heat and the increasing of wear resistance are not enough. Moreover, if the quantity of amorphous carbon 19 exceeds 60 vol %, the rate of resin binder phase 14 occupied in abrasive particle layer 11 will fall. As a result, the strength of abrasive particle layer 11 falls sharply and wear resistance of abrasive particle layer 11 drops.

Furthermore, the shore hardness of amorphous carbon 19 is set to Hs=100~120. If the shore hardness is less than 100, the deformation and partial wear of resin bonded abrasive tool 10 can not be controlled, because the hardness of amorphous carbon 19 is small. In addition, the decreasing of the generation of grinding heat by the decreasing of grinding resistance between works can not be controlled, because the lubricity is low. In addition, amorphous carbon 19 is produced by baking of phenol-formaldehyde resin at the temperature of 500° C.~3000° C. If the baking temperature is under than 600° C., the shore hardness Hs becomes less than 100. If the amorphous carbon 19 is baked at more high temperature, has higher hardness and it is excellent to lubricity. Preferably, the baking temperature is more than 700° C. In that case, it can be possible to get amorphous carbon 19 which the shore hardness Hs is 100~120. Thus, in resin bonded abrasive tool 10 in this example, the frictional resistance between working face and the surface of abrasive particle layer 11 in case of grinding machining is controlled. Also, the lubricity of resin binder phase 14 to work material can be held. Further it is possible to control the increasing of grinding heat, and also the wear resistance of abrasive particle layer 11 can be raised. The amorphous carbon 19 has the higher elastic modulus than that of phenol resin, for example, which forms resin binder phase 14. Therefore, the elastic modulus of abrasive particle layer 11 can be raised. Also, the compressive rigidity of abrasive particle layer 11 can be raised. Further, the mechanical strength of abrasive particle layer 14 which hold the super abrasive particle 15 can be raised.

Figure 4:
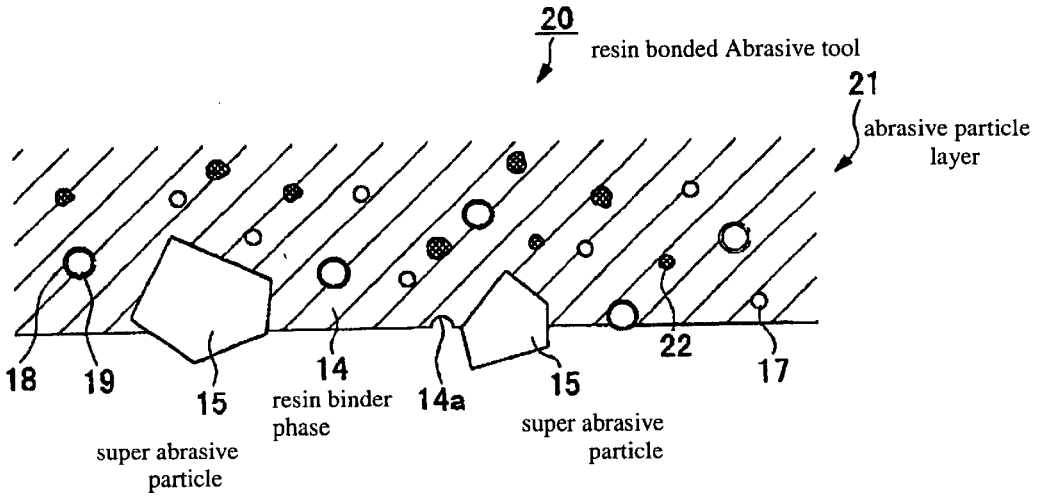
FIG. 4 is an enlarged sectional view of the principal part shown as the 1st modification of resin bonded abrasive tool of this example.
Figure 5:
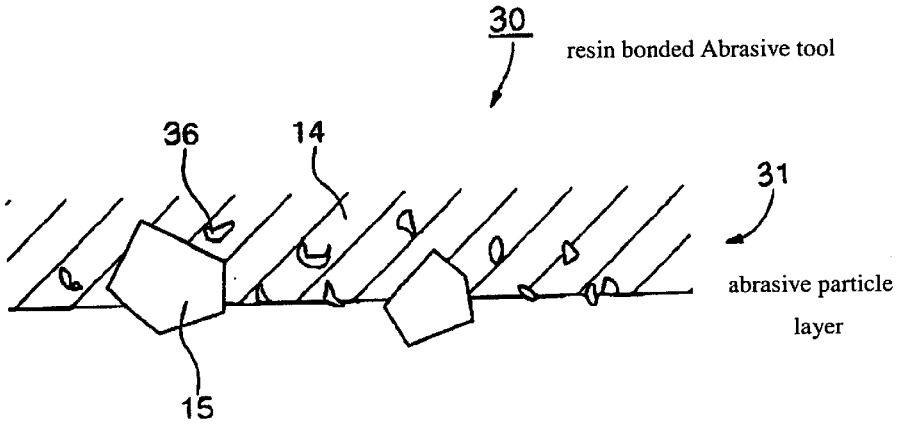
FIG. 5 is an enlarged sectional view of the principal part shown as the 2nd modification of resin bonded abrasive tool of this example.
Figure 6:
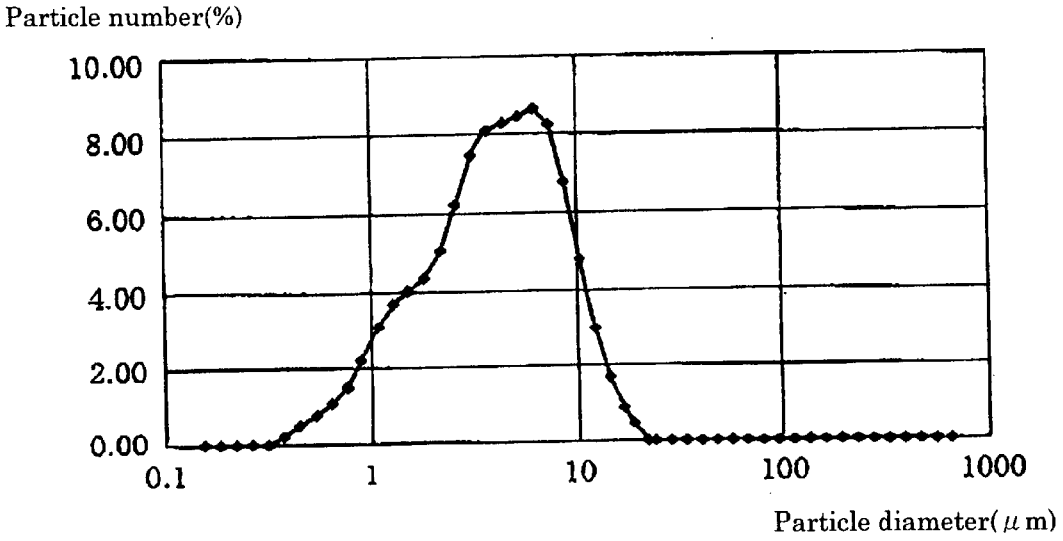
FIG. 6 is the particle size distribution of the non-uniform shape amorphous carbon which forms the filler shown in FIG. 5.
Figure 10:
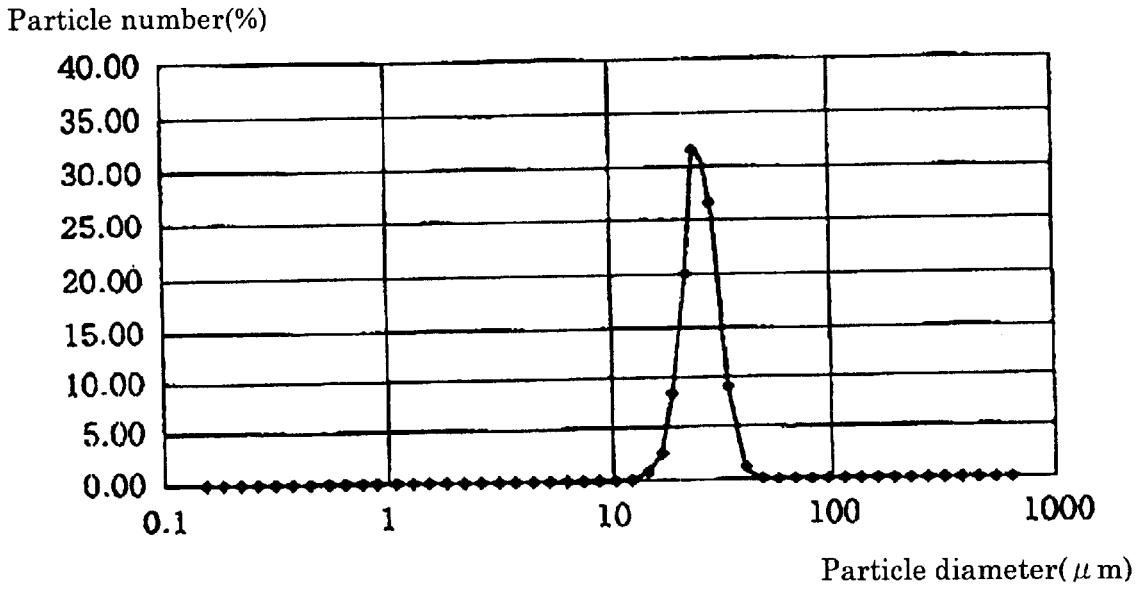
FIG. 10 is a particle size distribution of the spherical amorphous carbon used as filler for resin bonded abrasive tool by one example of conventional technology.

And as the amorphous carbon 19 is spherical shape, it can be relieved the stress which acts to the abrasive particle layer 11 can be raised. Furthermore, the amorphous carbon 19 acts as lubricant and decrease the grinding resistance between works. As a result, the generation of grinding heat can be controlled, for example. Also, the deformation of resin bonded abrasive tool 10 and partial wear can be efficiently controlled as the hardness and compressive strength, bending strength, etc. is higher than that of solid lubricants such as graphite, for example. And as the spherical amorphous carbon 19 exposed from the surface of abrasive particle layer 11 carries out point contact with grinding surface of work, even if the friction with work is occurred, the wear resistance is small and the generation of frictional heat is suppressed small. Furthermore, for example, comparing to the non-uniform type lubricant which unevenness is formed on a outer surface, the holding force by resin binder phase 14 is decreased. As a result, the omission from resin binder phase 14 is promoted, [and] the tip pocket 14*a* is formed, and the discharge ability of chip can be raised. Moreover, as the amorphous carbon 19 which is coated by metal such as Cu, etc. that has the high thermal conductivity is distributed in abrasive particle layer 11, the thermal conductivity of the abrasive particle layer can be raised, and it can be possible to emit quickly the grinding heat generated in a time of grinding machining from the abrasive particle layer 11, and the heat degradation of resin binder phase 14 can be prevented. Moreover, as the total amount of amorphous carbon 19 is made into the range of 5~60 vol % in a volume ratio of resin binder phase 14 except super abrasive particle 15 of abrasive particle layer 11, the effect of decreasing of not grinding heat enough and not increasing of wear resistance enough as in case of below 5 vol % can be prevented. Also, the fault which the wear resistance of abrasive particle layer 11 by decreasing sharply of the strength of abrasive particle layer 11 as in case of exceed 60 vol % can be prevented. Furthermore, as the shore hardness Hs of amorphous carbon 19 is set to Hs=100~120, it can be possible to prevent the deformation of resin bonded abrasive tool 10 and the partial wear in case of less than 100 of shore hardness. Also, it is possible to control the generation of grinding heat between works. Furthermore, the grinding resistance can be decreased without the decreasing of grinding ratio, because that amorphous carbon 19 is distributed in case that the wear resistant hard filler 16 is added to the resin binder phase 14 and the wear of abrasive particle layer 11 is reduced and the life of abrasive tool is prolonged. In addition, in this example, wear resistant filler 16 is distributed in resin binder phase 14, but it may not be limited to this. As the enlarged sectional view of a principal part of resin bonded abrasive tool 20 regarding to 1st modification of this example is shown in FIG. 4, the lubricative filler 22 and hollow glass 17 and amorphous carbon 19 having metal coated layer 18 are distributed in a resin binder phase 14. Here, although the lubricative filler 22 is not especially limited, fillers such as graphite, hBN, and fluoro-resin are desirable, particularly graphite. In this case, the grinding resistance is reduced by lubricative filler 22 distributed in resin binder phase 14 and the resin bonded abrasive tool 20 has excellent sharpness that is planned smoothly the grinding of work by super abrasive particle 15 in a time of grinding. In addition, as the amorphous carbon 19 is also added, the grinding ratio can be raised without increasing of grinding resistance. Also, the discharge ability of chip can be raised by forming of chip pocket on a surface of abrasive particle layer 21 based on the destruction of hollow glass 17. Further, the strength of abrasive particle layer 21 which has decreased by the addition of hollow glass 17 can be raised by amorphous carbon 19. As a result, it can be possible to obtain resin bonded abrasive tool 20 which is excellent in sharpness and also is improved in the strength of abrasive tool, particularly, in compressive strength. In addition, in this example mentioned above, although the hollow glass 17 and wear resistant filler 16 or lubricative filler 22 are distributed in a resin binder phase 14, it may not be limited to this, hollow glass 17 and wear resistant filler 16 and lubricative filler 22 may be omitted. Furthermore, in this example, although the metal coated layer 18 on a surface of amorphous carbon 19 is formed, it may not be limited to this. The metal coating layer 18 may be omitted. Moreover, in this example, although the hollow glass 17 is distributed in a resin binder phase 14, it may not be limited to this. The pore of 5~40 vol % in spite of hollow glass may be contained. In this case, the elasticity of abrasive particle layer 11, 21 can be raised, and it has a remarkable effect in an improvement of surface roughness in grinding of work. Here, if the pore is less than 5 vol %, the effect mentioned above is weak. Conversely, in case that the pore exceed 40 vol %, the strength of abrasive particle layer will decrease. Next, the results which grinding resistance and grinding ratio measured to each of this resin bonded abrasive tool in this invention and one example in conventional tool will be discussed. First, the super abrasive particle of diamond 15 is distributed in a resin binder phase 14 containing heat hardenable resin such as phenol resin, etc. This abrasive tool is called as 1st comparative example. The 1st example is the resin bonded abrasive tool that the amorphous carbon 19 is distributed in a resin binder phase 14 of resin bonded abrasive tool which is the 1st comparative example. The cutting resistance in the 1st example decreased to ½ of that in the 1st comparative example. And the grinding ratio in the 1st example improved 50% of that in the 1st comparative example. Next, the 2nd comparative example is a resin bonded abrasive tool that the graphite as the lubricative filler 22 is distributed in a resin binder phase 14 of the resin bonded abrasive tool in 1st comparative example. The 2nd example is a resin bonded abrasive tool that amorphous carbon 19 is distributed in a resin binder phase 14 of resin bonded abrasive tool in 2nd comparative example. The cutting resistance in 2nd example became almost equivalent to that of 2nd comparative example, and the grinding ratio in 2nd example improved twice than that of 2nd comparative example. Also, the maintenance nature of resin bonded abrasive tool improved. Furthermore, the 3rd comparative example is a resin bonded abrasive tool that the hollow glass 17 is distributed in a resin binder phase 14 of the resin bonded abrasive tool in 2nd comparative example. The 3rd example is a resin bonded abrasive tool that the ½~¾ of the added content of graphite which is added as the lubricative filler 22 is distributed in a resin binder phase 14 of a resin bonded abrasive tool in the 3rd comparative example is changed to amorphous carbon 19. Next, the strength of abrasive tool in 3rd comparative example is too weak and is not practical for use. However, in the 3rd example, the strength of abrasive tool, particularly, compressive strength, were able to improve and the resin bonded abrasive tool excellent to sharpness was able to be obtained. Next, the 4th comparative example is a resin bonded abrasive tool that SiC as wear resistant filler 16 is distributed in a resin binder phase 14 of resin bonded abrasive tool in the 1 st comparative example. The 4th example is a resin bonded abrasive tool that amorphous carbon 19 is distributed in a resin binder phase 14 of a resin bonded abrasive tool in this 4th comparative example. The cutting resistance in this 4th example became to ½ of that of 4th comparative example, and cutting ratio in 4th example is almost equivalent to that of 4th comparative example. Moreover, the 5th comparative example is a resin bonded abrasive tool that SiC and Cu as the wear resistant filler 16 is distributed in resin binder phase 14 of resin bonded abrasive tool in the 1st comparative example. The 5th example is a resin bonded abrasive tool that the amorphous carbon 19 is distributed in a resin binder phase 14 of a resin bonded abrasive tool in the 5th comparative example. The cutting resistance in 5th example became to ⅖ of that in 5th comparative example, and the grinding ratio was almost equivalent. And the 6th comparative example is a resin bonded abrasive tool that the hollow glass 17 as pore is distributed in a resin binder phase 14 of resin bonded abrasive tool in 4th comparative example. The 6th example is a resin bonded abrasive tool that the amorphous carbon 19 is distributed in a resin binder phase 14 of a resin bonded abrasive tool in this 6th comparative example. The cutting resistance in the 6th example became to ⅗ of that in the 6th comparative example, and the grinding ratio was almost equivalent. Moreover, the 7th example is a resin bonded abrasive tool that the pore is formed by using the foaming agent. etc. in forming of resin binder phase 14 in spite of the hollow glass 17 in resin bonded abrasive tool in 6th example. The surface roughness in the surface of grinding in 7th example was improved 10% compared to that in 6th comparative example, and the surface roughness in 7th example was improved 30% of that in 6th comparative example. From the results mentioned above, by distributing the amorphous carbon 19 in a resin binder phase 14, it can be possible to decrease the cutting resistance, and it can be possible to improve the grinding ratio without increasing the grinding resistance for the resin bonded abrasive tool which is excellent in sharpness. On the other hand, it can check that grinding resistance can be reduced without reducing a grinding ratio for a resin bonded abrasive tool which the life of abrasive tool is long. Next, a resin bonded abrasive tool 30 by the 2nd modification of this example will be discussed, referring to an appended drawings. FIG. 5 is enlarged sectional view of a principal part showing resin bonded abrasive tool 30 by 2nd modification in this example [and]. FIG. 6 is a particle diameter distribution of non-uniform amorphous carbon which is a filler shown in FIG. 5. Table 2 is a particle distribution of non-uniform amorphous carbon shown in FIG. 6. This resin bonded abrasive tool 30, for example, is formed as cup type abrasive tool for miller grinding of hard and brittle materials. The abrasive particle layer 31 is constructed from a resin binder phase 14 and a super abrasive particle 15 of diamond (or cBN etc.) distributed in this resin binder phase 14. Also amorphous carbon as filler 36 is distributed in a resin binder phase 14. The filler 36 including resin binder phase 14, for example, consist of nonuniform shape amorphous carbon, for example, as shown in Table 1 and in FIG. 10. Such carbon comes from grinding spherical amorphous carbon which the particle diameter is about 20~30 μm. The particle diameter of non-uniform shape amorphous carbon as the filler 36 is made preferably as 20 μm or less, average particle diameter is made preferably as 4.0 μm. When the particle diameter of filler 36 is less than 0.1 μm, the effect which reduces the grinding resistance and controls generating of grinding heat, and the effect of increasing wear resistance are weak. Conversely, when the particle diameter of filler 36 exceeds 20 μm, the distributed pitch of amorphous carbon will be extended, and the contact length between work and resin will increase. Also, grinding resistance will be increased. The total amount of filler 36 is made into 5~60 vol % by the volume ratio of resin binder phase 14 except super abrasive particle 15 of abrasive particle layer 31 for example. Here, when the quantity of filler 36 is less than 5 vol %, the effect by containing the filler 36, for example, the reducing of grinding heat by grinding resistance and the increasing of wear resistance are not enough. Moreover, if the quantity of filler 36 exceeds 60 vol %, the rate of resin binder phase 14 occupied in abrasive particle layer 31 will fall, and the strength of abrasive particle layer 31 falls sharply, and the wear resistance of abrasive particle layer 31 falls.

Figure 7:
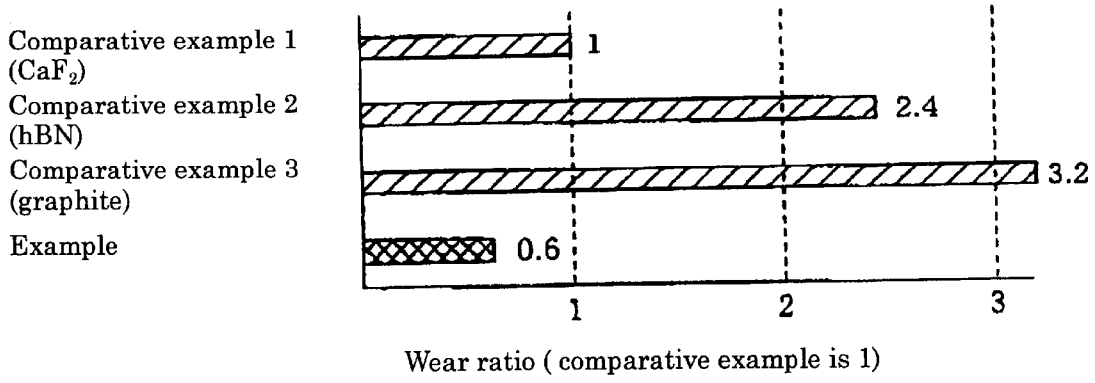
FIG. 7 is the wear ratio of resin bonded abrasive tool by the case of the example in this invention and comparative example 1, 2, 3.
Figure 8:
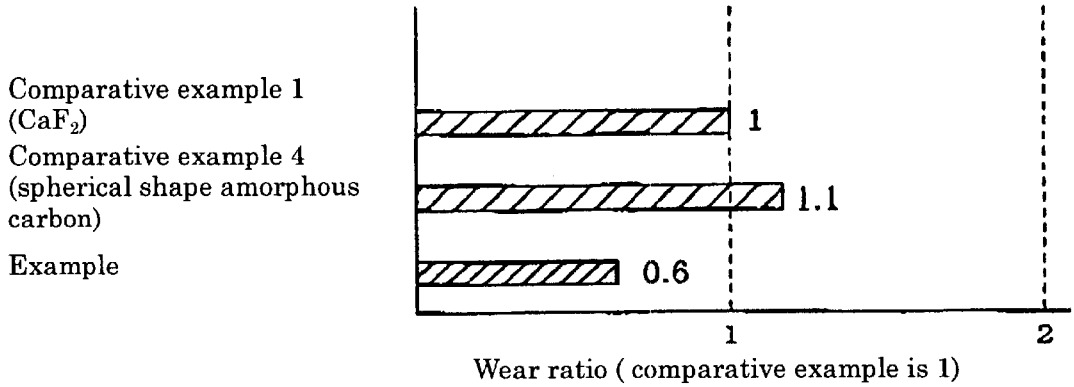
FIG. 8 is the wear ratio of resin bonded abrasive tool by the case of the example in this invention and the comparative example 1, 4.
Figure 9:
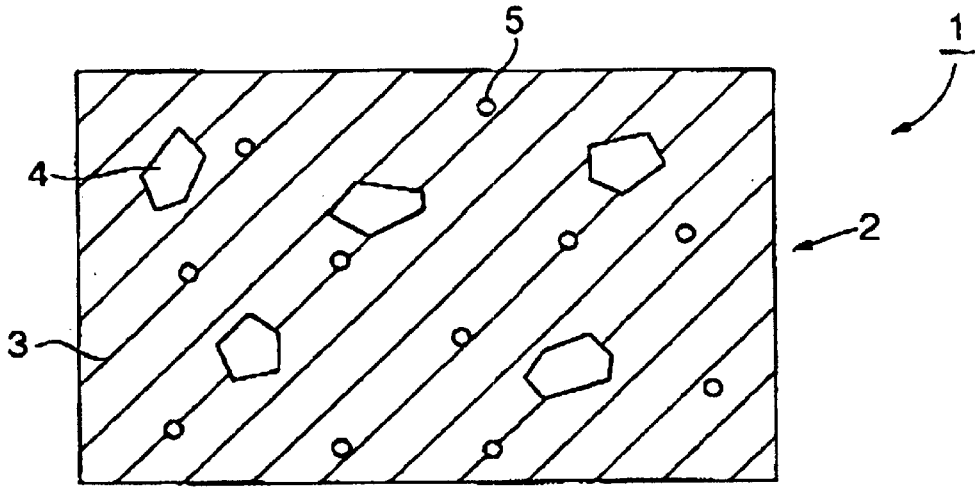
FIG. 9 is a sectional view shown about the conventional resin bonded abrasive tool.

In this resin bonded abrasive tool 30, the non-uniform amorphous carbon is distributed in resin binder phase 14 of abrasive particle layer 31 as filler 36. This filler 36, for example, is formed by crushing practically spherical amorphous carbon which the particle diameter is 20~30 μm, the particle diameter is preferably set to 20 μm or less. Therefore, the affinity with resin binder phase 14 is high, and the residual ability within abrasive particle layer 31 is high. As a result, the frictional resistance between working face in a time of grinding machining and the surface of abrasive particle layer 31 can be suppressed, the lubricity the resin binder phase 14 for work material will be secured, and the rise of grinding heat can be controlled. Also, the wear resistance of abrasive particle layer 31 can be raised. And the amorphous carbon is the most minute at the spherical shape, and the minute and small and non-uniform shape amorphous carbon can be obtained by crushing this spherical shape amorphous carbon. Next, the grinding examination which followed this resin bonded abrasive tool 30 is explained. In resin bonded abrasive tool 30 of this grinding examination, the phenol resin was used as resin binder phase 14 of abrasive particle layer 11, and the diamond abrasive particle which the mean particle diameter is 3~8 μm as the super abrasive particle 15 was distributed in this resin binder phase 14. And filler 36 of 35 vol % was added as a volume ratio to the resin binder phase 14 (phenol resin). Here, in the comparative example 1, the $CaF_2$ which the mean particle diameter is about 2 μm as the filler 36. In comparative example 2, the hBN which the mean particle diameter is about 3 μm was used as filler. In comparative example 3, the graphite (crystal carbon) which the mean particle diameter is about 7 μm was used as filler. In comparative example 4, as shown in Table 1 and FIG. 10, the spherical shape amorphous carbon which the mean particle diameter is about 20~20 μm was used as filler. In example, as shown in Table 2 and FIG. 6, the non-uniform. shape amorphous carbon obtained by crushing spherical amorphous carbon of comparative example 4 which the mean particle diameter is 20 μm or less was used as filler. In the grinding examination, the amount of wear of resin bonded abrasive tool 30 at the time of performing the miller grinding of silicon wafer was measured about the comparative example 1, 2, 3, 4 and the example. The measured results is shown in FIG. 7 and FIG. 8. In addition, in FIG. 7 and FIG. 8, the measurement results of the wear ratio to $CaF_2$ was shown about the comparative example 2, 3, 4 and the example as that the amount of wear in $CaF_2$ of comparative example L is 1. From the results shown in FIG. 7, the wear resistance of resin bonded abrasive tool 30 can be raised by using the nonuniform shape amorphous carbon compared with the case where $CaF_2$, hBN, Graphite (crystal carbon) was used as filer. Furthermore, from the results shown in FIG. 8, the wear resistance of resin bonded abrasive tool 30 can be raised by using the non-uniform shape amorphous carbon which the mean particle diameter is 20 μm or less obtained by crushing the spherical shape amorphous carbon compared with the case where the spherical shape amorphous carbon which the mean particle diameter is about 20~30 μm as filler. In addition, in above mentioned explanation, it is shown the example that the resin bonded abrasive tool 10, 20, 30 regarding to this invention was used for miller grinding. However, it is not limited in this case, the resin bonded abrasive tool 10, 20, 30 in this invention may adopt to other kinds of grinding.

TABLE 1

Particle distribution of spherical shape amorphous carbon

| Ch. | Particle Diameter (μm) | Particle number (%) |
|---|---|---|
| 1 | 704.0 | 0.00 |
| 2 | 592.0 | 0.00 |
| 3 | 497.8 | 0.00 |
| 4 | 418.6 | 0.00 |
| 5 | 352.0 | 0.00 |
| 6 | 296.0 | 0.00 |
| 7 | 248.9 | 0.00 |
| 8 | 209.3 | 0.00 |
| 9 | 176.0 | 0.00 |
| 10 | 148.0 | 0.00 |
| 11 | 124.5 | 0.00 |
| 12 | 104.7 | 0.00 |
| 13 | 88.00 | 0.00 |
| 14 | 74.00 | 0.00 |
| 15 | 62.23 | 0.00 |
| 16 | 52.33 | 0.00 |
| 17 | 44.00 | 1.21 |
| 18 | 37.00 | 9.04 |
| 19 | 31.11 | 26.38 |
| 20 | 26.16 | 31.40 |
| 21 | 22.00 | 19.83 |
| 22 | 18.50 | 8.66 |
| 23 | 15.56 | 2.82 |
| 24 | 13.08 | 0.66 |
| 25 | 11.00 | 0.00 |
| 26 | 9.250 | 0.00 |
| 27 | 7.778 | 0.00 |
| 28 | 6.541 | 0.00 |
| 29 | 5.500 | 0.00 |
| 30 | 4.625 | 0.00 |
| 31 | 3.889 | 0.00 |
| 32 | 3.270 | 0.00 |
| 33 | 2.750 | 0.00 |
| 34 | 2.312 | 0.00 |
| 35 | 1.945 | 0.00 |
| 36 | 1.635 | 0.00 |
| 37 | 1.375 | 0.00 |
| 38 | 1.156 | 0.00 |
| 39 | 0.972 | 0.00 |
| 40 | 0.818 | 0.00 |
| 41 | 0.688 | 0.00 |
| 42 | 0.578 | 0.00 |
| 43 | 0.486 | 0.00 |
| 44 | 0.409 | 0.00 |
| 45 | 0.344 | 0.00 |

TABLE 1-continued

Particle distribution of spherical shape amorphous carbon

| Ch. | Particle Diameter (μm) | Particle number (%) |
|---|---|---|
| 46 | 0.289 | 0.00 |
| 47 | 0.243 | 0.00 |
| 48 | 0.204 | 0.00 |
| 49 | 0.172 | 0.00 |
| 50 | 0.145 | 0.00 |

TABLE 2

Particle distribution of non-uniform shape amorphous carbon

| Ch. | Particle Diameter (μm) | Particle number (%) |
|---|---|---|
| 1 | 704.0 | 0.00 |
| 2 | 592.0 | 0.00 |
| 3 | 497.8 | 0.00 |
| 4 | 418.6 | 0.00 |
| 5 | 352.0 | 0.00 |
| 6 | 296.0 | 0.00 |
| 7 | 248.9 | 0.00 |
| 8 | 209.3 | 0.00 |
| 9 | 176.0 | 0.00 |
| 10 | 148.0 | 0.00 |
| 11 | 124.5 | 0.00 |
| 12 | 104.7 | 0.00 |
| 13 | 88.00 | 0.00 |
| 14 | 74.00 | 0.00 |
| 15 | 62.23 | 0.00 |
| 16 | 52.33 | 0.00 |
| 17 | 44.00 | 0.00 |
| 18 | 37.00 | 0.00 |
| 19 | 31.11 | 0.00 |
| 20 | 26.16 | 0.00 |
| 21 | 22.00 | 0.00 |
| 22 | 18.50 | 0.47 |
| 23 | 15.56 | 0.91 |
| 24 | 13.08 | 1.70 |
| 25 | 11.00 | 2.97 |
| 26 | 9.250 | 4.78 |
| 27 | 7.778 | 6.78 |
| 28 | 6.541 | 8.27 |
| 29 | 5.500 | 8.68 |
| 30 | 4.625 | 8.45 |
| 31 | 3.889 | 8.28 |
| 32 | 3.270 | 8.10 |
| 33 | 2.750 | 7.44 |
| 34 | 2.312 | 6.23 |
| 35 | 1.945 | 5.06 |
| 36 | 1.635 | 4.36 |
| 37 | 1.375 | 4.06 |
| 38 | 1.156 | 3.75 |
| 39 | 0.972 | 3.12 |
| 40 | 0.818 | 2.27 |
| 41 | 0.688 | 1.57 |
| 42 | 0.578 | 1.11 |
| 43 | 0.486 | 0.82 |
| 44 | 0.409 | 0.57 |
| 45 | 0.344 | 0.25 |
| 46 | 0.289 | 0.00 |
| 47 | 0.243 | 0.00 |
| 48 | 0.204 | 0.00 |
| 49 | 0.172 | 0.00 |
| 50 | 0.145 | 0.00 |

What is claimed is:

1. A resin bonded abrasive tool comprising a resin binder phase comprising a resin;

super abrasive particles distributed in the resin binder phase; and amorphous carbon particles distributed in the resin binder phase, wherein the amorphous carbon particles are coated with a metal.

2. The resin bonded abrasive tool of claim 1, wherein the super abrasive particles are selected from the group consisting of diamonds and cubic boron nitride (CBN).

3. The resin bonded abrasive tool of claim 1, wherein the amorphous carbon has bending strength of about 16 $kg/mm^2$.

4. The resin bonded abrasive tool of claim 1, wherein the amorphous carbon has compressive strength of about 120 $kg/mm^2$.

5. The resin bonded abrasive tool of claim 1, wherein the amorphous carbon has shore hardness of between 100 and 120.

6. The resin bonded abrasive tool of claim 1, wherein the amorphous carbon particles are of non-uniform shape.

7. The resin bonded abrasive tool of claim 6, wherein the diameter of amorphous carbon particles is 20 $\mu$m or less.

8. The resin bonded abrasive tool of claim 1, wherein the amorphous carbon particles are spherical.

9. The resin bonded abrasive tool of claim 8, wherein the diameter of the spherical amorphous carbon particles is between 0.1 and 2 times the diameter of the super abrasive particles.

10. The resin bonded abrasive tool of claim 1, wherein the amorphous carbon is present in an amount between 5% and 60% by volume of the resin binder phase.

11. The resin bonded abrasive tool of claim 1, wherein the resin binder phase further comprises a wear resistant filler.

12. The resin bonded abrasive tool of claim 1, wherein the resin binder phase further comprises a lubricative filler.

13. The resin bonded abrasive tool of claim 1, wherein the resin binder phase further comprises hollow glass.

14. The resin bonded abrasive tool of claim 1, wherein the resin binder phase further comprises pores in an amount of between 5% and 40% by volume of the resin binder phase.

15. The resin bonded abrasive tool of claim 4, wherein the amorphous carbon has bending strength of about 16 $kg/mm^2$.

16. The resin bonded abrasive tool of claim 1, wherein the amorphous carbon has bending strength of about 16 $kg/mm^2$.

17. The resin bonded abrasive tool of claim 3, wherein the amorphous carbon has compressive strength of about 120 $kg/mm^2$.

18. The resin bonded abrasive tool of claim 5, wherein the amorphous carbon has compressive strength of about 120 $kg/mm^2$.

19. The resin bonded abrasive tool of claim 3, wherein the amorphous carbon has shore hardness of between 100 and 120.

20. The resin bonded abrasive tool of claim 4, wherein the amorphous carbon has shore hardness of between 100 and 120.

21. A method of forming an abrasive tool, the method comprising distributing super abrasive particles and amorphous carbon particles in a resin binder phase; and forming the resin bonded abrasive tool of claim 1.

* * * * *